US007565865B2

(12) United States Patent
Fujishiro et al.

(10) Patent No.: US 7,565,865 B2
(45) Date of Patent: Jul. 28, 2009

(54) PLATE INSERTING DEVICE

(75) Inventors: Shinichi Fujishiro, Chiba (JP); Toshiaki Momoi, Chiba (JP)

(73) Assignee: Komori Corporation, Tokyo (JP)

( * ) Notice: Subject to any disclaimer, the term of this patent is extended or adjusted under 35 U.S.C. 154(b) by 578 days.

(21) Appl. No.: 11/472,207

(22) Filed: Jun. 20, 2006

(65) Prior Publication Data

US 2007/0006759 A1 Jan. 11, 2007

(30) Foreign Application Priority Data

Jun. 30, 2005 (JP) ..... 2005-191244

(51) Int. Cl.
*B41F 27/12* (2006.01)

(52) U.S. Cl. ..... 101/477; 101/415.1; 101/480

(58) Field of Classification Search ..... 101/477, 101/479, 480, 415.1
See application file for complete search history.

(56) References Cited

U.S. PATENT DOCUMENTS 5,617,792 A * 4/1997 Rau et al. ..... 101/477
5,868,072 A * 2/1999 Nishi ..... 101/415.1
6,393,986 B1 5/2002 Tobe et al.
6,973,876 B2 * 12/2005 Nakano et al. ..... 101/477

* cited by examiner

*Primary Examiner*—Leslie J Evanisko
(74) *Attorney, Agent, or Firm*—Blakely, Sokoloff, Taylor & Zafman LLP

(57) ABSTRACT

A plate inserting device includes a plate cylinder, roller, and rotation braking unit. The plate cylinder has a groove portion in its outer surface to extend in an axial direction. A plate is to be mounted on the outer surface of a plate cylinder. The roller is rotatably supported to be able to come close to and separate from the outer surface of the plate cylinder. The roller comes into contact with the outer surface of the plate cylinder, when a distal end bent portion of a new plate is to be inserted in the groove portion of the plate cylinder, to press the distal end bent portion of the new plate. The rotation braking unit brakes rotation of the roller in relation to insertion operation of the distal end bent portion of the new plate into the groove portion of the plate cylinder.

17 Claims, 9 Drawing Sheets

PLATE INSERTING DEVICE

BACKGROUND OF THE INVENTION

The present invention relates to a plate inserting device for inserting the distal end bent portion of a new plate into the groove portion of a plate cylinder.

As shown in U.S. Pat. No. 6,393,986 a conventional plate inserting device comprises a plate cylinder on which a plate is to be mounted and a plate-inserting press roller which is pivotally supported to be able to be thrown on/off with respect to the outer surface of the plate cylinder. When inserting a plate, the plate cylinder is rotated with the press roller being in contact with the outer surface of the plate cylinder. Then, the press roller abuts against the distal end bent portion of the new plate to be supplied to the plate cylinder so as to insert the distal end bent portion of the new plate into the groove portion of the plate cylinder.

In the conventional plate inserting device described above, as the press roller is supported rotatably, it rotates when inserting the distal end bent portion of the new plate into the groove portion of the plate cylinder. Hence, as shown in FIG. 9A, a distal end bent portion 5*a* of a new plate 5 does not come into tight contact with an inclined surface 32*a* of an elongated groove 32 of a plate cylinder 6 but is spaced apart from it due to its own weight. This state becomes typical as the new plate 5 becomes bulky and its weight increases. When the distal end bent portion 5*a* of the new plate 5 is spaced apart from the inclined surface 32*a*, even when a winding rod 33 is pivoted to clamp the distal end bent portion 5*a*, the suspended state of the distal end bent portion 5*a* cannot be eliminated. Consequently, the new plate 5 may be erroneously mounted in a shifted state by being twisted at its leading edge and trailing edge in the widthwise direction of the plate, as indicated by an alternate long and two short dashed line in FIG. 9B.

SUMMARY OF THE INVENTION

It is an object of the present invention to provide a plate inserting device which prevents a plate from being mounted in a state shifted in the widthwise direction of the plate, so the new plate attaching accuracy is improved.

In order to achieve the above object, according to the present invention, there is provided a plate inserting device comprising a plate cylinder which has a groove portion in an outer surface thereof to extend in an axial direction and on an outer surface of which a plate is to be mounted, a roller which is rotatably supported to be able to come close to and separate from the outer surface of the plate cylinder and which comes into contact with the outer surface of the plate cylinder, when a distal end bent portion of a new plate is to be inserted in the groove portion of the plate cylinder, to press the distal end bent portion of the new plate, and braking means for braking rotation of the roller in relation to insertion operation of the distal end bent portion of the new plate into the groove portion of the plate cylinder.

DESCRIPTION OF THE PREFERRED EMBODIMENT

A plate inserting device according to an embodiment of the present invention will be described with reference to FIGS. 1 to 8.

Figure 1:
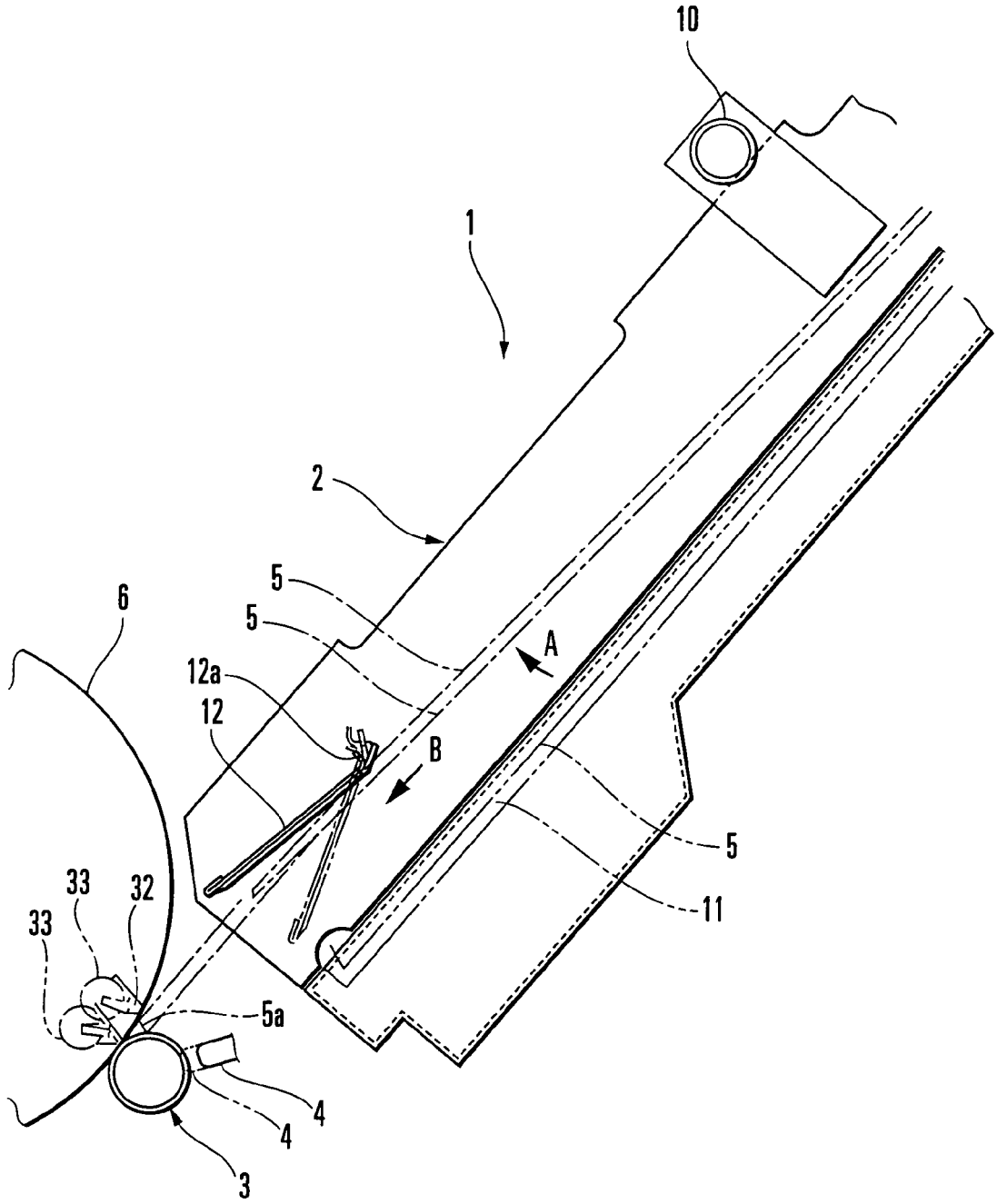
FIG. 1 is a side view of a plate inserting device according to an embodiment of the present invention.

A plate inserting device 1 shown in FIG. 1 comprises a loader 2 which supplies a new plate 5 to a plate cylinder 6, a plate-inserting press roller 3 which is rotatably supported to be able to come into contact with and separate from the outer surface of the plate cylinder 6, and a press member 4 which brakes the rotation of the roller 3. A groove portion 32 having an inclined surface 32*a* is formed in the outer surface of the plate cylinder 6 to extend in the axial direction of the plate cylinder 6.

The loader 2 is supported by frames (not shown) to be swingable clockwise or counterclockwise in FIG. 1 about a pivot shaft 10 as a pivot center. When the loader 2 is pivoted clockwise in FIG. 1 by an air cylinder (not shown), the distal end of the loader 2 comes close to the plate cylinder 6 to be able to supply a plate.

A plate storing portion 11 for storing the new plate 5 is formed in the loader 2 to extend in the longitudinal direction of the loader 2. The new plate 5 stored in the plate storing portion 11 is held by its own weight as its rear end bent portion (not shown) is supported by a bar (not shown). When the new plate 5 held in the plate storing portion 11 is to be supplied from the loader 2 to the plate cylinder 6, the new plate 5 moves from the position indicated by an alternate long and two short dashed line in FIG. 1 to a plate suppliable position in the direction of an arrow A (the direction of thickness of the plate).

In this state, when the support bar is released, the new plate 5 is pushed out in a direction B, and the distal end bent portion 5*a* projects from the lower end of the loader 2 and is guided to the outer surface of the plate cylinder 6, as indicated by an alternate long and short dashed line in FIG. 1. At this time, a corner 5*b* of the distal end bent portion 5*a* abuts against the outer surface of the roller 3. A plate supply guide plate 12 is supported at the distal end of the loader 2 to be swingable clockwise/counterclockwise about a proximal end 12*a* as a pivot center. The plate supply guide plate 12 is pivoted clockwise by an air cylinder (not shown) and positioned at the position indicated by a solid line in FIG. 1, thereby guiding the new plate 5 from inside the loader 2 to the roller 3 and plate cylinder 6.

A driving section which brings the roller 3 into contact with and separates it from the outer surface of the plate cylinder 6 will be described with reference to FIGS. 2 and 3 and 7A to 7C. The cylinder end of a first air cylinder 15 is pivotally supported by frames 16 of the loader 2, as shown in FIG. 3. Air is selectively supplied to the end- and rod-side ports of the first air cylinder 15 through a solenoid valve and pressure adjusting regulators which set the pressures of the air from a pump to high and low pressures. This switches the pressing force of the roller 3 generated by the air cylinder 15 with respect to the outer surface of the plate cylinder 6.

Figure 7A:
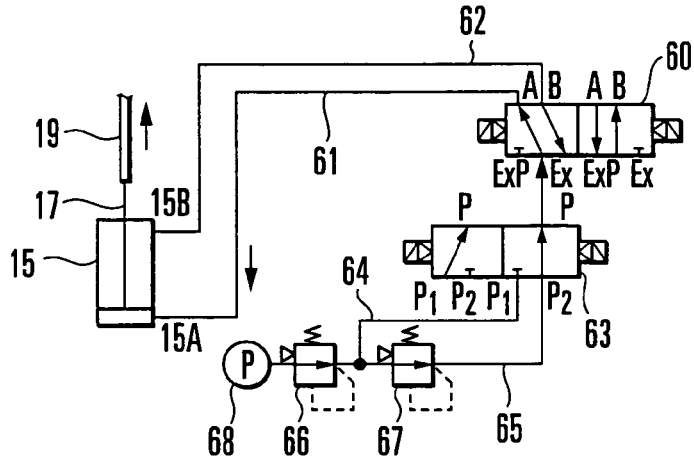
FIG. 7A is a circuit diagram of an air supply unit in a mode in which the pressing force of the roller with respect to the outer surface of the plate cylinder is low.
Figure 7B:
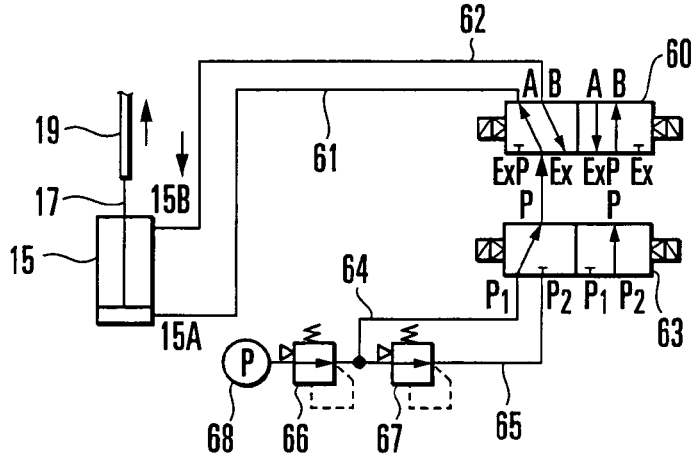
FIG. 7B is a circuit diagram of the air supply unit in a mode in which the pressing force of the roller with respect to the outer surface of the plate cylinder is high.
Figure 7C:
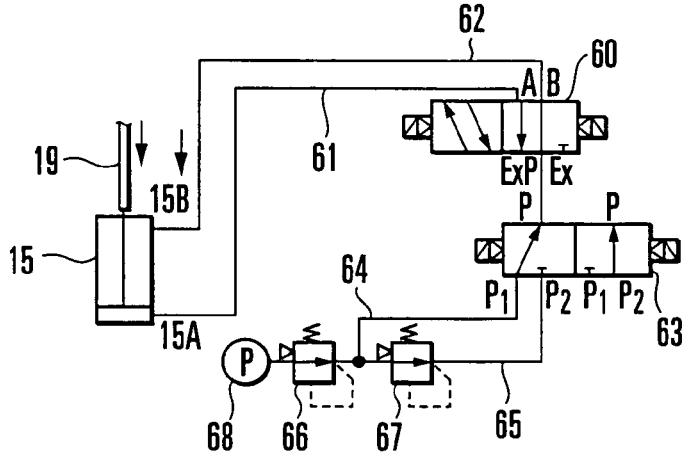
FIG. 7C is a circuit diagram of the air supply unit in a mode in which the roller is thrown off from the outer surface of the plate cylinder.

An air cylinder driving solenoid valve 60 to drive the air cylinder 15 has three ports A, B, and P, as shown in FIGS. 7A to 7C. Of the three ports, the port A is connected to a side to move a rod 17 of the first air cylinder 15 forward, i.e., an end-side port 15A, through an air tube 61. The port B is connected to a side to move the rod 17 of the first air cylinder 15 backward, i.e., a rod-side port 15B, through an air tube 62. The port P is connected to a port P of a switching solenoid valve 63.

The solenoid valve 60 is selectively switched between two modes, i.e., a mode in which the port A is connected to the port P and the port B is opened to the atmospheric pressure, and a mode in which the port B is connected to the port P and the port A is opened to the atmospheric pressure.

The switching solenoid valve 63 has three ports, i.e., the port P and ports P1 and P2. Of the three ports, the port P1 is connected to a pump 68 through an air tube 64 and regulator 66, and the port P2 is connected to the pump 68 through an air tube 65 and the regulators 66 and 67. The switching solenoid valve 63 is switched between two modes, i.e., a mode in which the port P1 is connected to the port P and the port P2 is closed, and a mode in which the port P1 is closed and the port P2 is connected to the port P.

The pressure adjusting regulator 66 sets the pressure of air discharged from the pump 68 to the high pressure and supplies it to the port P1 of the switching solenoid valve 63. The pressure adjusting regulator 67 is connected to the discharge side of the regulator 66, sets the pressure to a relatively low pressure, and supplies the low pressure to the port P2 of the switching solenoid valve 63.

Figure 2:
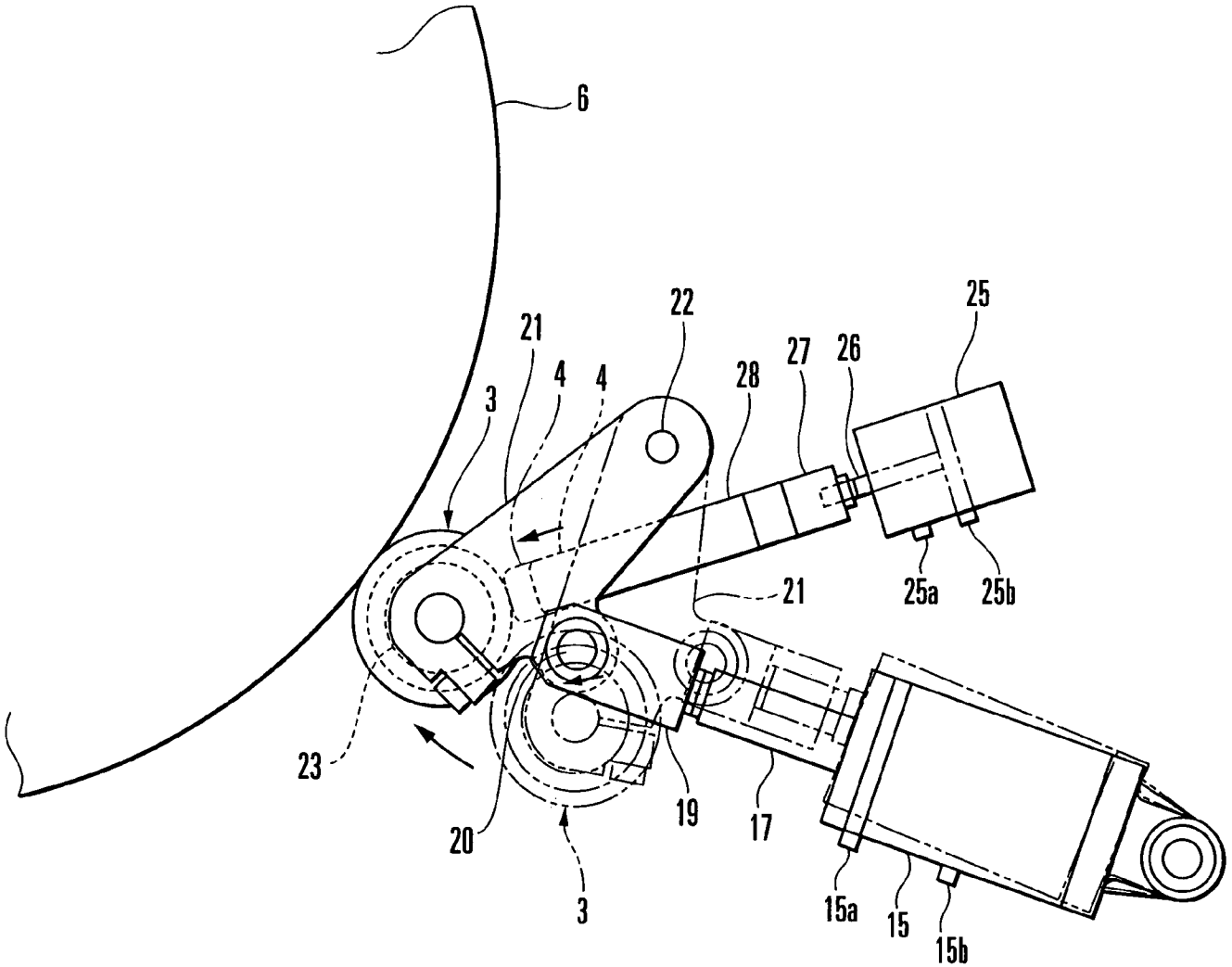
FIG. 2 is an enlarged side view of the main part of the plate inserting device shown in FIG. 1.
Figure 3:
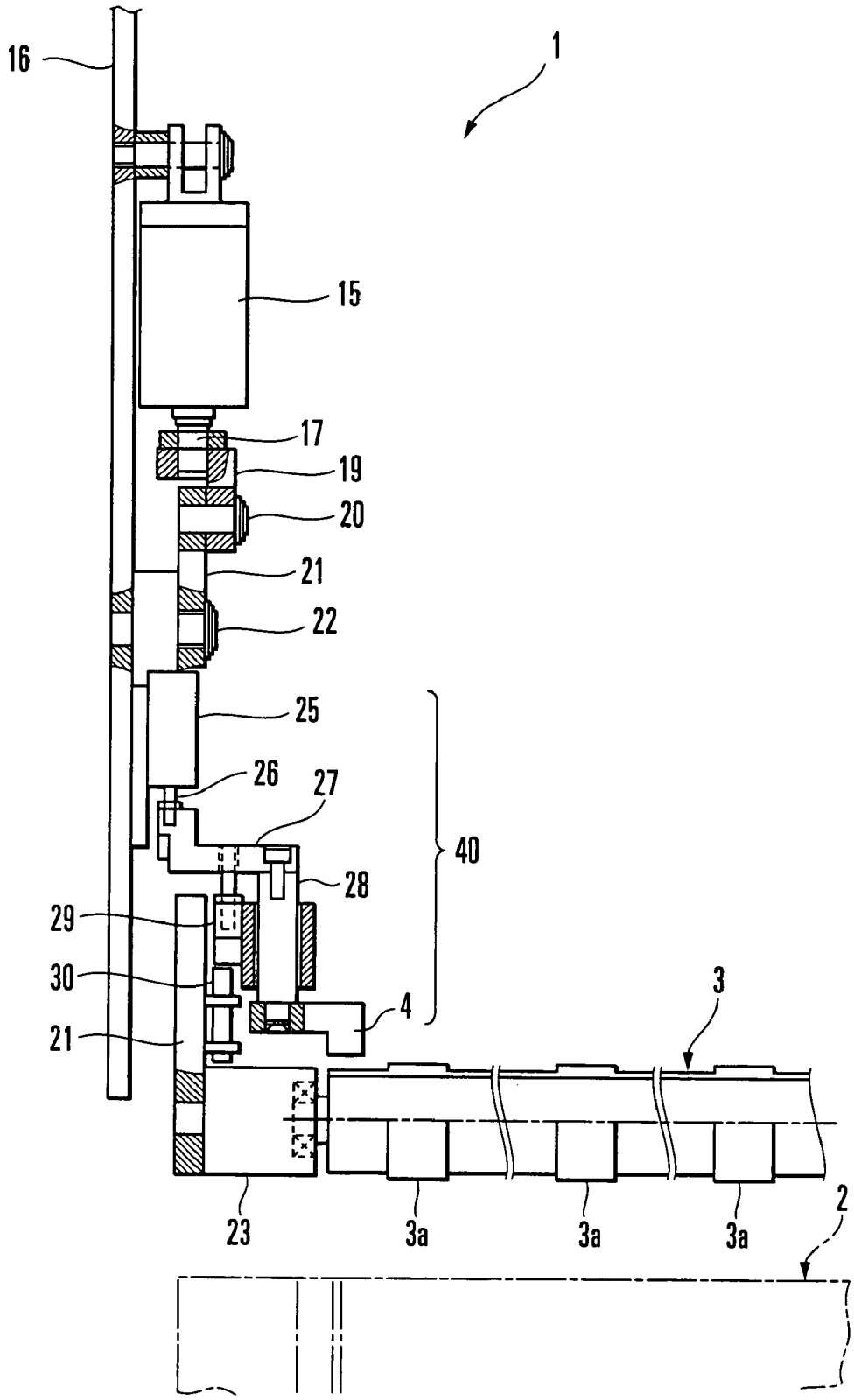
FIG. 3 is a partially sectional developed front view of the main part of the plate inserting device shown in FIG. 1.

As shown in FIG. 2, the first air cylinder 15 comprises an autoswitch 15*a* which detects the moving end limit of the rod 17 that has moved forward, and an autoswitch 15*b* which detects the moving end limit of the rod 17 that has moved backward. When inserting the distal end bent portion 5*a* of the new plate 5 into the elongated groove 32 of the plate cylinder 6, the autoswitch 15*a* also detects that the distal end bent portion 5*a* cannot be inserted in the elongated groove 32 and the new plate 5 is suspended from the outer surface of the plate cylinder 6. More specifically, the autoswitch 15*a* detects that the rod 17 has slightly moved backward as the roller 3 is spaced apart from the outer surface of the plate cylinder 6 against the pressing force generated by the rod 17 of the first air cylinder 15.

One end of a moving element 19 is fixed to the distal end of the rod 17. The substantial center of a lever 21 is pivotally mounted on the other end of the moving element 19 through a pin 20. One end of the lever 21 is swingably, pivotally supported through a shaft 22 extending vertically between the frames 17. The other end of the lever 21 rotatably supports the roller 3 through a bearing holder 23. A plurality of large-diameter portions 3*a* are formed on the outer surface of the roller 3 equidistantly in the axial direction.

When the rod 17 of the first air cylinder 15 moves backward, the roller 3 is spaced apart from the outer surface of the plate cylinder 6, as indicated by an alternate long and two shirt dashed line in FIG. 2. When the rod 17 moves forward, the lever 21 pivots clockwise about the shaft 22 as a pivot center, and the large-diameter portions 3*a* of the roller 3 come into contact with the outer surface of the plate cylinder 6.

A braking unit for the roller 3 will be described. As shown in FIG. 3, a second air cylinder 25 serving as a driving source for the braking unit is fixed to the corresponding frame 16. One end of a substantially inverted-L-shaped connecting element 27 is fixed to the distal end of a rod 26 of the second air cylinder 25. The second air cylinder 25 comprises an autoswitch 25*a* which detects the moving end limit of the rod 26 that has moved forward, and an autoswitch 25*b* which detects the moving end limit of the rod 26 that has moved backward. One end of a stud 28 extending parallel to the frame 16 is fixed to the other end of the connecting element 27. An L-shaped press member 4 is fixed to the other end of the stud 28. An engaging member 29 is fixed to the connecting element 27, and a stopper 30 is fixed to the lever 21. When the press member 4 moves forward and its distal end presses the outer surface of the roller 3, the stopper 30 engages with the engaging member 29 to apply an appropriate braking force of the press member 4 to the roller 3.

In this arrangement, after the rod 17 of the first air cylinder 15 moves forward and the roller 3 comes into contact with the outer surface of the plate cylinder 6, the rod 26 of the second air cylinder 25 moves forward. When the rod 26 moves forward, the press member 4 also moves forward through the connecting element 27 and stud 28 to press the outer surface of the roller 3. Thus, the press member 4 brakes the roller 3 to regulate its rotation.

A plate gripping portion will be described with reference to FIGS. 4A and 4B. The elongated groove (groove portion) 32 is formed in the outer surface of the plate cylinder 6 in the axial direction, and the winding rod 33 is pivotally inserted to extend in the elongated groove 32. The winding rod 33 has a kerf 34 which has a substantially V-shaped groove and extends in the axial direction. A retainer 36 positioned by a pin (not shown) is accommodated in the kerf 34. The two ends of the retainer 36 are bent in the same direction to form a plate leading edge holding end 36*a* and plate trailing edge holding end 36*b*.

Figure 4A:
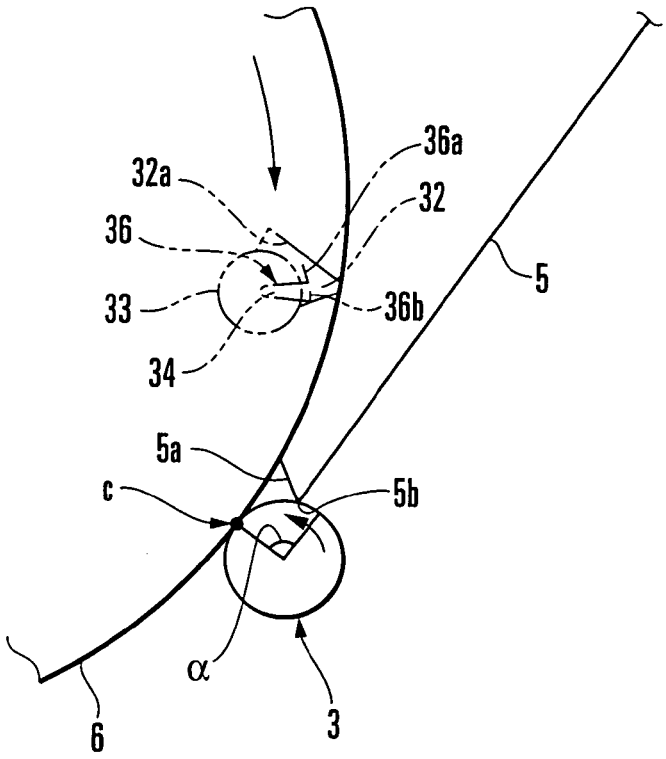
FIG. 4A is a view showing a state wherein the corner of the distal end bent portion of a new plate abuts against a roller.
Figure 4B:
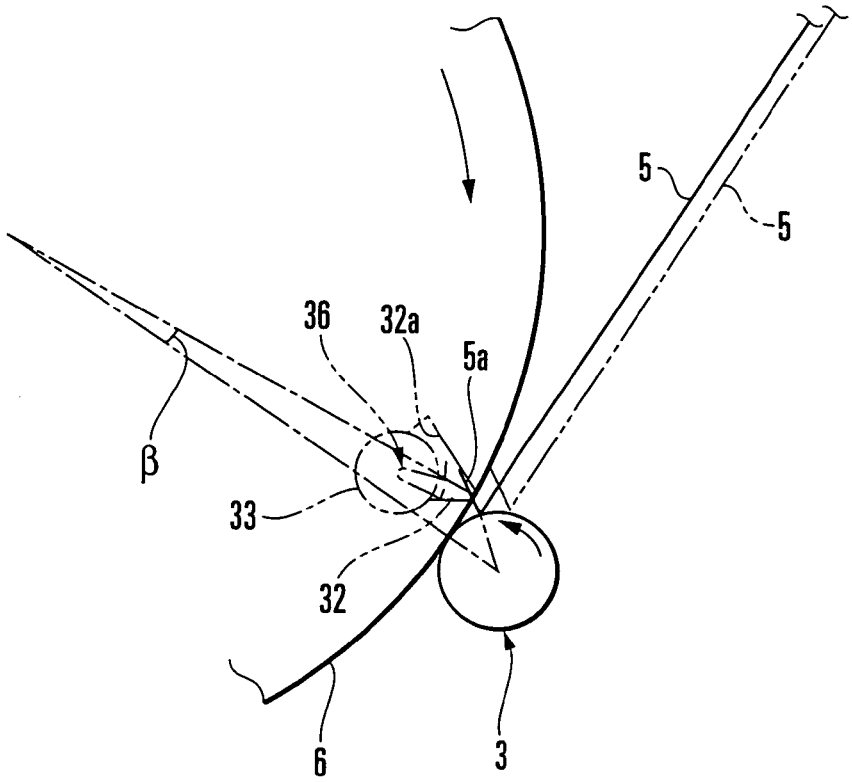
FIG. 4B is a view showing a state wherein the distal end bent portion of the new plate starts insertion in the groove portion of a plate cylinder.

In this arrangement, when the winding rod 33 is pivoted clockwise in FIG. 4A, the distal end bent portion 5*a* of the new plate 5 inserted through the elongated groove 32 is inserted between the inclined surface 32*a* of the elongated groove 32 and the plate leading edge holding end 36*a* of the retainer 36. When the plate cylinder 6 is subsequently rotated by one revolution, the rear end bent portion (not shown) of the new plate 5 is inserted in the elongated groove 32 to engage with the plate trailing edge holding end 36*b* of the retainer 36. Then, when the winding rod 33 is pivoted counterclockwise in FIG. 4B, the distal end bent portion 5*a* of the new plate 5 is clamped between the inclined surface 32*a* of the elongated groove 32 and the plate leading edge holding end 36*a* of the retainer 36, so the new plate 5 is mounted on the plate cylinder 6.

Figure 8:
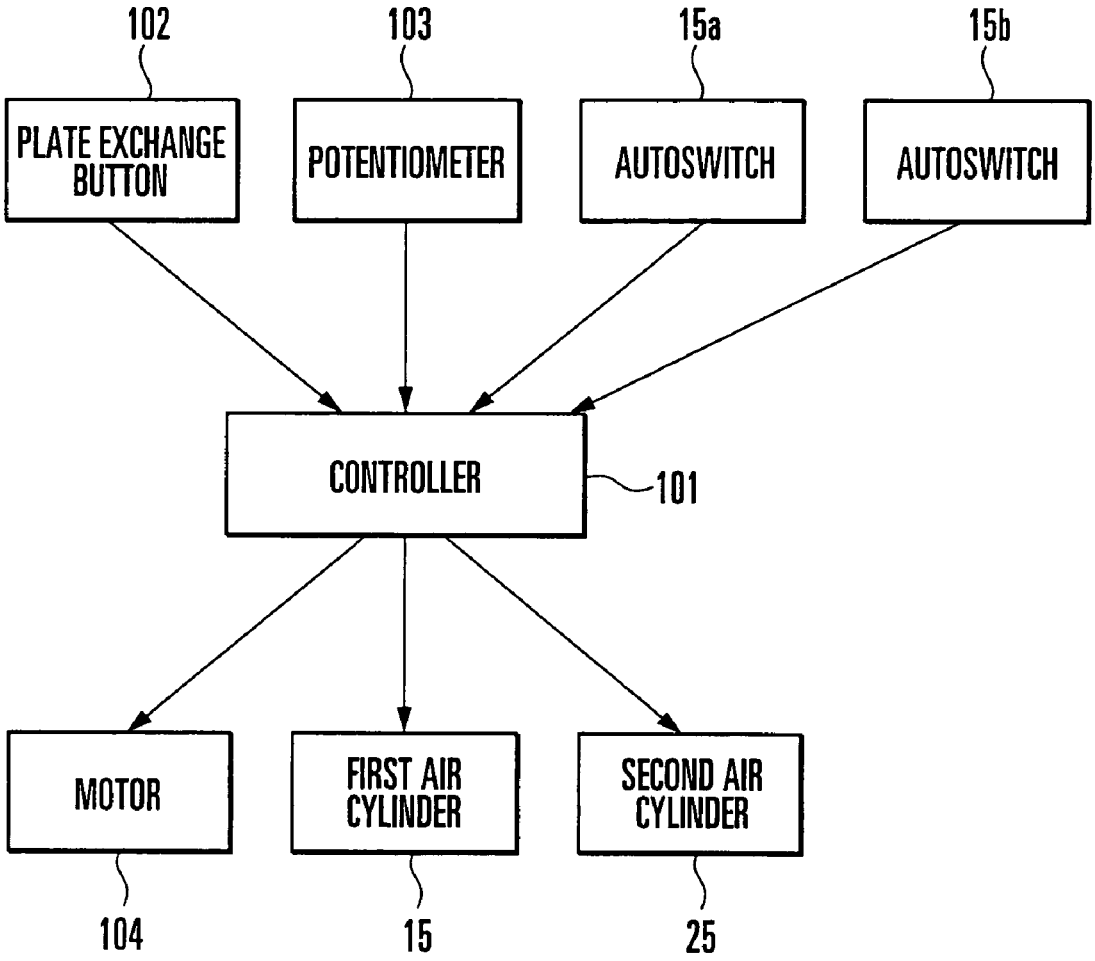
FIG. 8 is a block diagram showing the electrical arrangement of the plate inserting device shown in FIG. 1.
Figure 9A:
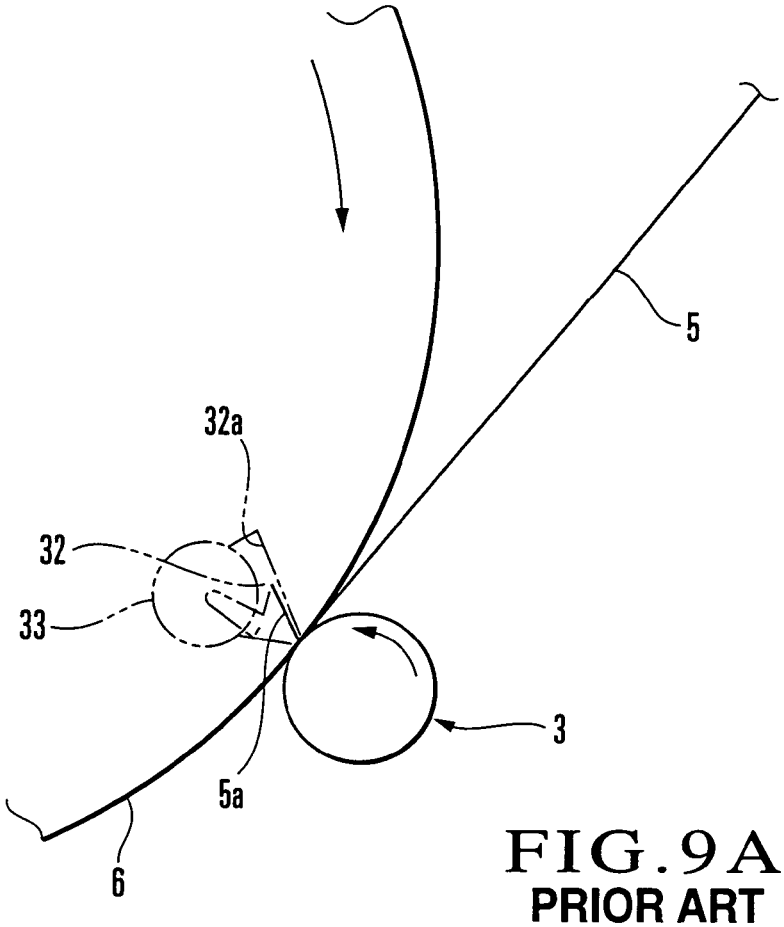
FIG.9A PRIOR ART
FIG. 9A is an enlarged sectional view of the main part of a conventional plate inserting device.
Figure 9B:
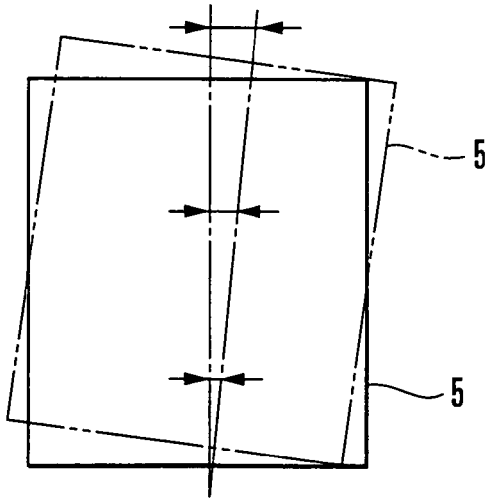
FIG.9B PRIOR ART
FIG. 9B is a view for explaining a plate mounting error in the conventional plate inserting device shown in FIG. 9A.

As shown in FIG. 8, in addition to the autoswitches 15*a* and 15*b* and first and second air cylinders 15 and 25 described above, a plate exchange button 102 which designates plate exchange operation, a potentiometer 103 which detects the rotational phase of the plate cylinder 6 on the basis of a pulse signal generated as the plate cylinder 6 rotates, and a motor 104 which drives the printing press are connected to a controller 101. The potentiometer 103 detects the respective rotational phases of the plate cylinder 6 with which the plate cylinder 6 corresponds to the positions shown in FIG. 4A, FIG. 4B (insertion start), FIG. 5A (after insertion completion), and FIG. 5B. The controller 101 receives outputs from the autoswitches 15*a* and 15*b*, plate exchange button 102, and potentiometer 103 and controls the driving operation of the first and second air cylinders 15 and 25 and motor 104.

Plate insertion operation in the plate inserting device having the above arrangement will be described.

When an air cylinder (not shown) is actuated, the loader 2 pivots clockwise in FIG. 1 about the pivot shaft 10 as a pivot center, and the lower end of the loader 2 comes close to the outer surface of the plate cylinder 6, as shown in FIG. 1. Subsequently, the rod 17 of the first air cylinder 15 moves forward to bring the roller 3 into contact with the outer surface of the plate cylinder 6, as indicated by a solid line in FIG. 2. At this time, as shown in FIG. 7A, the air cylinder driving solenoid valve 60 is set in the mode in which the port P is connected to the port A and the port B is opened to the atmospheric pressure. The switching solenoid valve 63 is switched by the actuation of the other solenoid to the mode in which the port P is connected to the port P2.

As described above, the pressure of air to be supplied to the port P2 by the regulator 67 is set to be relatively lower than the pressure of air to be supplied to the port P1 by the regulator 66. As low-pressure air is supplied to the end-side port 15A of the first air cylinder 15, the pressing force of the roller 3 with respect to the outer surface of the plate cylinder 6, which is generated by the first air cylinder 15, becomes low.

Then, the air cylinder (not shown) operates to pivot the plate supply guide plate 12 clockwise in FIG. 1 about the proximal end 12*a* as a pivot center, and the plate supply guide plate 12 is held at the position indicated by a solid line. In this state, the new plate 5 supported by the new plate support bar is released and pushed out in the direction A in FIG. 5 by a pushout mechanism (not shown). Thus, as shown in FIG. 4A, the distal end bent portion 5*a* projects from the lower end of the loader 2 and is guided to the outer surface of the plate cylinder 6, so the corner 5*b* of the distal end bent portion 5*a* abuts against the outer surface of the roller 3.

At this time, the corner 5*b* of the distal end bent portion 5*a* abuts against the outer surface of the roller 3 within the range of an angle $\alpha$ from a contact point C of the plate cylinder 6 and roller 3 in a circumferential direction in the upstream rotational direction of the roller 3. The angle $\alpha$ is set at such an angle that the distal end bent portion 5*a* abutting against the outer surface of the roller 3 is reliably guided toward the contact point C by the outer surface of the roller 3. According to this embodiment, $\alpha=90°$. After this, the plate cylinder 6 is pivoted clockwise in FIG. 4A, so the distal end bent portion 5*a* of the new plate 5 abutting against the outer surface of the roller 3 is reliably guided into the elongated groove 32 of the plate cylinder 6, as shown in FIG. 4B.

When the potentiometer 103 detects the rotational phase of the plate cylinder 6 which corresponds to insertion start of the distal end bent portion 5*a* of the new plate 5 into the elongated groove 32, the controller 101 drives the second air cylinder 25. When the second air cylinder 25 is driven, the rod 26 moves forward to move the press member 4 forward through the connecting element 27 and stud 28 so as to press the outer surface of the roller 3. Thus, the press member 4 brakes the roller 3 and regulates its rotation. Hence, the press member 4, second air cylinder 25, rod 26, connecting element 27, and stud 28 constitute a rotation braking unit (40) (braking means) of the roller 3.

Figure 5A:
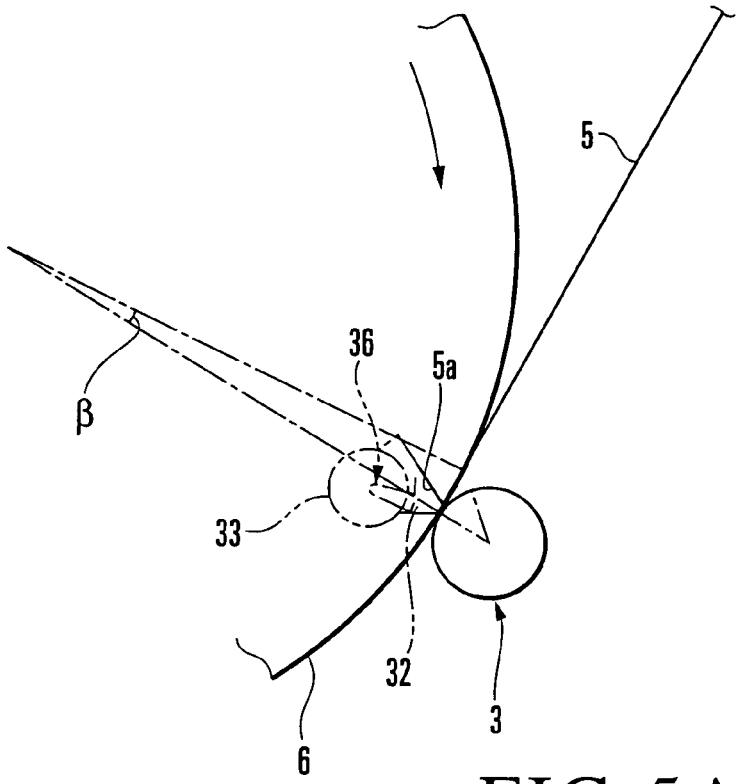
FIG. 5A is a view showing a state wherein the distal end bent portion of the new plate is inserted in the groove portion of the plate cylinder.

In this manner, the roller 3 is regulated from being rotated by the contact pressure with the plate cylinder 6 to follow the rotation of the plate cylinder 6, so the rotation of the roller 3 is kept stopped. Thus, the distal end bent portion 5*a* of the new plate 5 is also prevented from being moved by the rotation of the roller 3. Hence, as the plate cylinder 6 rotates, the distal end bent portion 5*a* of the new plate 5 is reliably inserted in the elongated groove 32 of the plate cylinder 6 by the roller 3, as shown in FIG. 5A, and comes into tight contact with the inclined surface 32*a* of the groove 32 evenly in the widthwise direction of the plate cylinder 6.

Figure 6:
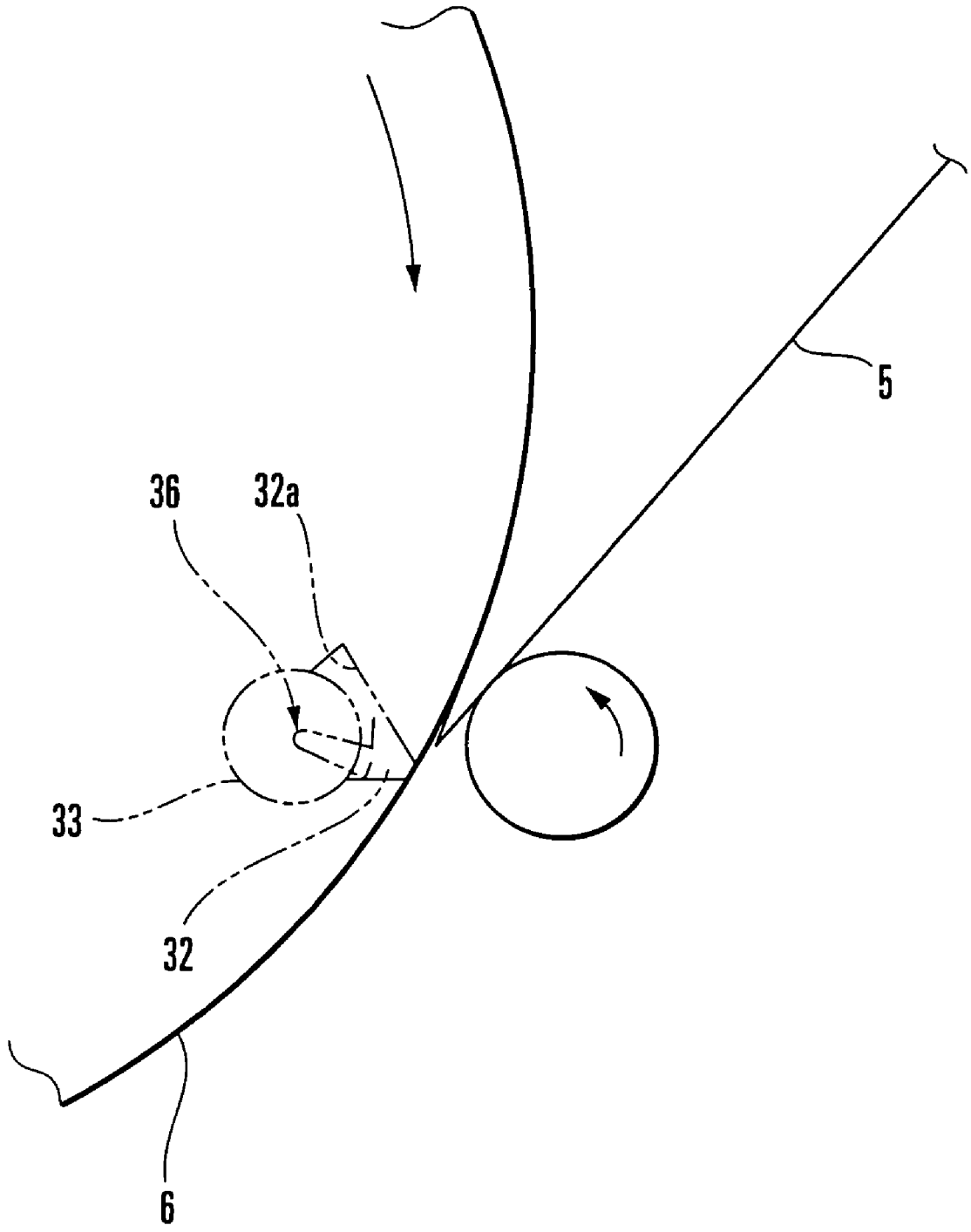
FIG. 6 is a view showing an insertion error state of the distal end bent portion of the new plate.

As shown in FIG. 6, if the distal end bent portion 5*a* of the new plate 5 is not inserted in the elongated groove 32 of the plate cylinder 6, the new plate 5 is suspended from the outer surface of the plate cylinder 6. The distal end bent portion 5*a* enters the contact point C of the plate cylinder 6 and roller 3, so the roller 3 separates from the outer surface of the plate cylinder 6. Thus, the rod 17 of the first air cylinder 15 slightly moves backward. The autoswitch 15*a* detects the insertion error, and stop control of the printing press takes place.

If an insertion error is not detected by the autoswitch 15*a*, it is indirectly confirmed that the distal end bent portion 5*a* of the new plate 5 is inserted in the elongated groove 32 of the plate cylinder 6. Subsequently, when the potentiometer 103 detects the rotational phase of the plate cylinder 6 corresponding to insertion completion of the distal end bent portion 5*a* of the new plate 5, the controller 101 controls the second air cylinder 25 to move the rod 26 backward. Thus, braking on the roller 3 is canceled, so the roller 3 can rotate. More specifically, braking on the roller 3 takes place within a range from a state (FIG. 4B) in which the distal end bent portion 5*a* of the new plate 5 starts being inserted in the elongated groove 32, through a state in which the plate cylinder 6 rotates by an angle $\beta$, to a state (FIG. 5A) in which the distal end bent portion 5*a* of the new plate 5 is inserted in the elongated groove 32 the plate cylinder 6.

Figure 5B:
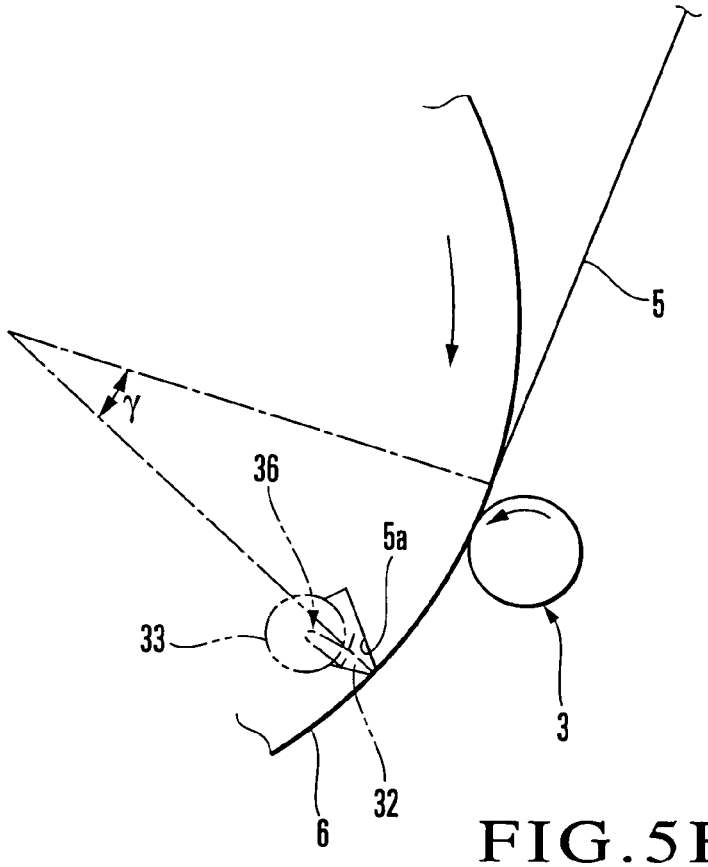
FIG. 5B is a view showing a state after the distal end bent portion of the new plate is inserted in the groove portion of the plate cylinder.

As shown in FIG. 5B, with the distal end bent portion 5*a* of the new plate 5 being inserted in the elongated groove 32, when the plate cylinder 6 further pivots, the air cylinder driving solenoid valve 60 is switched by the actuation of one solenoid to the mode in which the port P is connected to the port A and the port B is opened to the atmospheric pressure, as shown in FIG. 7B. Also, the switching solenoid valve 63 is switched by the actuation of one solenoid to the mode in which the port P is connected to the port P1.

The pressure of air to be supplied to the port P1 by the regulator 66 is set to be relatively higher than the pressure of air to be supplied to the port P2 by the regulator 67. Thus, high-pressure air is supplied to the end-side port 15A of the first air cylinder 15 to increase the pressing force of the roller 3, generated by the first air cylinder 15, with respect to the outer surface of the plate cylinder 6. More specifically, the range to decrease the pressing force of the roller 3, generated by the first air cylinder 15, with respect to the outer surface of the plate cylinder 6 is defined as a range from a state (FIG. 4B) in which the distal end bent portion 5*a* of the new plate 5 starts being inserted in the elongated groove 32, through a state in which the distal end bent portion 5*a* of the new plate 5 is inserted in the elongated groove 32 of the plate cylinder 6, to a state (FIG. 5B) in which the plate cylinder 6 further pivots, as indicated by an angle $\gamma$ in FIG. 5B.

In this manner, the end limit of the range to decrease the pressing force of the roller 3 with respect to the outer surface of the plate cylinder 6 is set not at the timing at which the distal end bent portion 5*a* of the new plate 5 is inserted in the elongated groove 32 of the plate cylinder 6, but at the timing, slightly delayed from this timing, at which the plate cylinder 6 is pivoted. Then, when a plate insertion error in which the new plate 5 enters between the plate cylinder 6 and roller 3 occurs and the printing press is stopped because the plate insertion error is detected, even if the printing press overruns until the plate cylinder 6 stops, the plate cylinder 6 and roller 3 will not deform the new plate 5. Thus, when a plate insertion error occurs, the new plate 5 can be reused.

If the roller 3 has been braked from a state (FIG. 4B) in which the distal end bent portion 5*a* of the new plate 5 starts being inserted in the elongated groove 32 of the plate cylinder 6 to an insertion completion state (FIG. 5A), the pressing force of the roller 3 with respect to the outer surface of the plate cylinder 6 is set low. Thus, the roller 3 which is in contact with the outer surface of the new plate 5 improves the attaching precision of the new plate 5 with respect to the plate cylinder 6.

After the distal end bent portion 5*a* of the new plate 5 is inserted in the elongated groove 32 of the plate cylinder 6, braking that has been applied to the roller 3 is canceled, so the roller 3 can rotate. Accordingly, friction caused by slippery does not occur between the roller 3 and the new plate 5 which is wound around the outer surface of the plate cylinder 6, so damage to the new plate 5 can be prevented. After the distal end bent portion 5*a* of the new plate 5 is inserted in the elongated groove 32 of the plate cylinder 6, the pressing force of the roller 3 with respect to the outer surface of the plate cylinder 6 is increased. Accordingly, the new plate 5 can be mounted in tight contact with the outer surface of the plate cylinder 6, so a plate mounting error can be prevented.

When the plate cylinder 6 is rotated substantially by one revolution so the new plate 5 is mounted on the outer surface of the plate cylinder 6, the air cylinder driving solenoid valve 60 is switched by the actuation of the other solenoid to the mode in which the port P is connected to the port B and the port A is opened to the atmospheric pressure, as shown in FIG. 7C. The switching solenoid valve 63 is switched by the actuation of one solenoid to the mode in which the port P is connected to the high-pressure port P1. Thus, high pressure air is supplied to the rod-side port 15B of the first air cylinder 15, so the rod 17 of the first air cylinder 15 moves backward to separate the roller 3 from the outer surface of the plate cylinder 6.

According to this embodiment, considering a plate insertion error, the timing to switch the contact pressure of the roller 3 with respect to the plate cylinder 6 from low to high is slightly delayed from the timing at which the new plate 5 is completely inserted in the elongated groove 32 of the plate cylinder 6. If plate insertion error detection is not performed, the contact pressure may be switched immediately after the new plate 5 is completely inserted in the elongated groove 32 of the plate cylinder 6.

Although the case has been described in which the roller 3 is supported rotatably, the present invention can also be applied to a case in which the roller which is directly driven by the motor to rotate or stop is rotated to follow the rotation of the plate cylinder 6.

As has been described above, according to the present invention, the distal end bent portion of the new plate can be inserted in the groove portion of the plate cylinder accurately and reliably, so the plate mounting accuracy with respect to the plate cylinder improves. Damage to the new plate to be wound around the outer surface of the plate cylinder can be prevented. A new plate insertion error can be detected. When a plate insertion error occurs, the plate can be reused.

What is claimed is:

1. A plate inserting device comprising:

a plate cylinder which has a groove portion in an outer surface thereof to extend in an axial direction and on said outer surface of which a plate is to be mounted;

a roller which is rotatably supported to be able to come close to and separate from said outer surface of said plate cylinder and which comes into contact with said outer surface of said plate cylinder, when a distal end bent portion of a new plate is to be inserted in said groove portion of said plate cylinder, to press the distal end bent portion of the new plate; and braking means for braking rotation of said roller in relation to insertion operation of the distal end bent portion of the new plate into said groove portion of said plate cylinder.

2. A device according to claim 1, wherein said braking means brakes rotation of said roller when insertion of the distal end bent portion of the new plate into said groove portion of said plate cylinder is started.

3. A device according to claim 2, wherein said braking means cancels braking rotation of said roller when insertion of the distal end bent portion of the new plate into said groove portion of said plate cylinder is completed.

4. A device according to claim 2, further comprising detection means for detecting a rotational phase of said plate cylinder, wherein said braking means brakes in response to a first rotational phase detection output from said detection means.

5. A device according to claim 4, wherein said braking means cancels braking in response to a second rotational phase detection output from said detection means which follows the first rotational phase detection output.

6. A device according to claim 1, wherein said braking means comprises a press member which presses a rotating surface of said roller to brake rotation of said roller, and driving means for driving said press member.

7. A device according to claim 6, wherein said driving means comprises a hydropneumatic cylinder having a rod which moves forward/backward, and as said rod of said hydropneumatic cylinder moves, said press member presses an outer surface of said roller.

8. A device according to claim 7, further comprising a connecting mechanism which connects said rod of said hydropneumatic cylinder to said press member.

9. A device according to claim 1, wherein a contact pressure of said roller with respect to said plate cylinder while inserting the distal end bent portion of the new plate into said groove portion of said plate cylinder is set to be lower than a contact pressure employed when winding the new plate around said plate cylinder.

10. A device according to claim 9, further comprising:

a switching solenoid valve which has a first port, a second port, and a third port and which is selectively switched between a first mode in which said second port is connected to said first port and said third port is closed, and a second mode in which said second port is closed and said third port is connected to said first port, and a pump which supplies air to generate the contact pressure of said roller with respect to said plate cylinder through said switching solenoid valve, wherein said second port is connected to said pump and said third port is connected to said pump through a regulator.

11. A device according to claim 1, wherein an abutting position of the distal end bent portion of the new plate with respect to said outer surface of said roller is set within 90° from a contact point of said plate cylinder and said roller in a circumferential direction in an upstream rotational direction of said roller.

12. A device according to claim 1, further comprising detection means for detecting that said roller which comes into contact with said outer surface of said plate cylinder separates from said outer surface of said plate cylinder while mounting the new plate on said plate cylinder.

13. A device according to claim 12, further comprising driving means for driving said roller so as to be thrown on/off with respect to said outer surface of said plate cylinder, wherein said detection means detects separation of said roller from said outer surface of said plate cylinder on the basis of a state of said driving means.

14. A device according to claim 13, wherein said driving means comprises a hydropneumatic cylinder having a rod which moves forward/backward, and said detection means comprises a switch member which detects a moving end limit of said rod when said roller is in contact with said plate cylinder.

15. A plate inserting device comprising:

a plate cylinder which has a groove portion in an outer surface thereof to extend in an axial direction and on said outer surface of which a plate is to be mounted;

a roller which is rotatably supported to be able to be thrown on/off with respect to said outer surface of said plate cylinder and which comes into contact with said outer surface of said plate cylinder, when a distal end bent portion of a new plate is to be inserted in said outer surface of said plate cylinder, to press the distal end bent portion of the new plate; and detection means for detecting that said roller which comes into contact with said outer surface of said plate cylinder separates from said outer surface of said plate cylinder while mounting the new plate on said plate cylinder.

16. A device according to claim 15, further comprising driving means for driving said roller so as to be thrown on/off with respect to said outer surface of said plate cylinder, wherein said detection means detects separation of said roller from said outer surface of said plate cylinder on the basis of a state of said driving means.

17. A device according to claim 16, wherein said driving means comprises a hydropneumatic cylinder having a rod which moves forward/backward, and said detection means comprises a switch member which detects a moving end limit of said rod when said roller is in contact with said plate cylinder.

* * * * *